US006712144B2

(12) United States Patent
Buytaert

(10) Patent No.: US 6,712,144 B2
(45) Date of Patent: Mar. 30, 2004

(54) METHOD FOR DRILLING MULTILATERAL WELLS WITH REDUCED UNDER-REAMING AND RELATED DEVICE

(75) Inventor: Jean P. Buytaert, Houston, TX (US)

(73) Assignee: Frank's International, Inc., Houston, TX (US)

( * ) Notice: Subject to any disclaimer, the term of this patent is extended or adjusted under 35 U.S.C. 154(b) by 2 days.

(21) Appl. No.: 09/800,850

(22) Filed: Mar. 7, 2001

(65) Prior Publication Data

US 2002/0023753 A1 Feb. 28, 2002

Related U.S. Application Data

(63) Continuation-in-part of application No. 09/649,731, filed on Aug. 28, 2000, now abandoned.

(51) Int. Cl.[7] ..... E21B 7/04

(52) U.S. Cl. ..... 166/313; 166/50; 166/117.6; 175/61; 175/80; 175/81

(58) Field of Search ..... 166/50, 117.6, 166/313; 175/61, 79, 80, 81, 82

(56) References Cited

U.S. PATENT DOCUMENTS 2,173,035 A * 9/1939 Armemtrout et al. ..... 166/235
2,207,345 A * 7/1940 Hammer ..... 166/285
2,858,107 A * 10/1958 Colmerauer ..... 166/100
5,289,876 A * 3/1994 Graham ..... 166/276
5,423,387 A * 6/1995 Lynde ..... 166/117.5
5,431,219 A * 7/1995 Leising et al. ..... 166/117.5
5,462,120 A * 10/1995 Gondouin
5,520,252 A * 5/1996 McNair ..... 166/313
5,803,176 A * 9/1998 Blizzard et al. ..... 166/117.6
5,915,474 A * 6/1999 Buytaert et al.
5,937,955 A * 8/1999 Nims et al. ..... 166/241.1
5,960,873 A * 10/1999 Alexander et al. ..... 166/117.6
6,006,835 A * 12/1999 Onan et al. ..... 166/295
6,056,059 A * 5/2000 Ohmer
6,116,344 A * 9/2000 Longbottom et al. ..... 166/298
6,135,208 A * 10/2000 Gano et al. ..... 166/117.6
6,260,623 B1 * 7/2001 Schick

* cited by examiner

*Primary Examiner*—Hoang Dang
(74) *Attorney, Agent, or Firm*—The Matthews Firm

(57) ABSTRACT

An improved method for drilling a lateral well from an existing wellbore is disclosed whereby a section of said existing wellbore is preferably enlarged such as by under-reaming. The enlarged section is filled with a material such as, for example, epoxy which hardens to form an impermeable body. The hardened material is drilled out laterally and also longitudinally, such that a sealed junction is formed within the impermeable body between the lateral well and existing well. The longitudinal drilling follows an arcuate path. In one embodiment of the present invention, a packer positioned within the enlarged section may be filled with the pumped material to thereby avoid any contamination of the material with other downhole elements such as mud and oil whereby the composition of the pumped material is consistent and known. In one embodiment, an arcuate drillable guide may be positioned in the enlarged section prior to filling the enlarged section with material. The arcuate drillable guide thereby subsequently guides a drill bit through the hardened material along an arcuate path for reconnecting the existing wellbore through the enlarged section.

12 Claims, 6 Drawing Sheets

METHOD FOR DRILLING MULTILATERAL WELLS WITH REDUCED UNDER-REAMING AND RELATED DEVICE

This application is a continuation-in-part of U.S. patent application Ser. No. 09/649,731 filed Aug. 28, 2000, now abandoned.

TECHNICAL FIELD

The present invention relates generally to a method for drilling and, more particularly, the present invention relates to an improved method for drilling one or more lateral wells.

BACKGROUND ART

My previous U.S. Patent Application cited hereinabove discloses how to provide a reliably sealed junction with a lateral well wherein one preferred embodiment utilizes an under-reamed section of borehole. In some cases, it may be desirable to limit the diameter of the under-reamed section for reasons discussed hereinafter. The present application describes how a smaller diameter under-reamed section can be used and still provide, if desired, a lateral wellbore having a diameter substantially the same as the primary well.

Drilling multilateral or horizontal wells from an initial wellbore has become an increasingly popular method for enhancing production and recovery of oil and gas from wellbores. In many cases, the use of multilateral wells has dramatically increased the profitability of oil and gas wells as compared to that of conventional wells. As a result of an increased return on investment, the drilling of multilateral wells has become and is projected to further develop into an important aspect of well enhancement. Moreover, the drilling of multilateral wells has significantly increased the efficiency of oil and gas recovery operations. Multilateral well techniques have been found to be especially effective in areas where the pay-zone or oil/gas deposit may be thin or hard to reach with standard downhole drilling operations.

One primary advantage for drilling multilateral wells involves cost reductions obtained by utilizing a previously drilled wellbore. In drilling multilateral wells, a driller can dramatically reduce the cost of drilling a new well by beginning the new drilling operations at a convenient kickoff depth in a previously existing well. Therefore, many of the modern methods that have been developed for drilling lateral wells make use of an existing wellbore to eliminate the additional cost of drilling the wellbore from the surface.

The technique of drilling multilateral wells has typically consisted of laterally drilling from a previously drilled borehole, sometimes referred to as the primary borehole. It should be noted that the previously drilled borehole is typically cased and cemented, but methods exist in the art for open hole operations, i.e., wellbores or wellbore sections which are not cased or cemented.

However, prior art methods of drilling lateral boreholes suffer from a common significant problem of providing a good seal at the junction between the primary wellbore and the lateral wellbore and/or reliably maintaining this sealed junction over time. If there is a poor seal at this junction, then leakage may occur between the primary borehole and one or more of the lateral boreholes. Leakage at the junction may prevent the possibility of good zone isolation. Zone isolation is an important aspect in the success of many oil and gas recovery operations and may also be required by governmental regulations either now or in the future. Thus, the lack of a reliable seal at this junction is a significant potential problem for multilateral well operations.

My prior application, as identified hereinbefore, discloses in one embodiment use of an under-reamed section of primary borehole which may have a diameter larger than three times the diameter of the primary borehole. However, under-reaming may be problematic in some cases, especially as the size diameter of the under-reamed section increases. For instance, greater torque on the hole opening string is required for larger diameter under-reaming. The larger torque required may lead to more mechanical failures. As well, larger amounts of earth have to be removed from the borehole. Another problem relates to subsequent operations. Depending on the well program, wellbore strings inserted after the under-reaming or hole opening, especially in deviated wells, may tend to be more difficult to guide past the under-reamed section. Thus, the larger the diameter of under-reaming or hole opening, the more likely it is that problems may arise due to the under-reaming or hole opening. Thus, the present invention teaches a drilling method using a reduced diameter under-reamer or hole opener.

A common example of the prior art drilling methods is embodied in U.S. Pat. No. 5,458,209 to Hayes et al. (the '209 patent). The '209 patent discloses a method and system for drilling a lateral well with respect to a primary well which is cased. The method discloses positioning a guide means defined as comprising three main parts; a lower end, a central part with an angled ramp and an upper end, and drilling out the casing along the guide at a preselected location. This method may be used to effectively drill multilateral wells, but does not insure a sealed junction.

Accordingly, it would be desirable to somehow provide a method and/or device for drilling one or more lateral wells and establishing a sealed junction between the lateral well and the primary wellbore.

U.S. Pat. No. 5,564,503 to Longbottom et al (the '503 patent) discloses a method of drilling a lateral well encompassing the steps of setting a diverter within a wellbore, boring through the sidewall of the wellbore at a desired location, lining the lateral well, and cementing the periphery of the junction around the lateral well to obtain a pressure bearing seal around the wellbore. One difficulty encountered when cementing using conventional techniques is that of ensuring a homogeneous flow of cement at the periphery of the junction because of the presence of tubulars and the limited space between the tubulars and the formation about the junction. Another common difficulty is ensuring a uniform fill of the cement about the junction without leaving spaces or voids because of the irregular shape of the interstices about the junction. Accordingly, this method does not necessarily provide a homogeneous cement bond around a lateral well. Another difficulty encountered with the method disclosed in the '503 patent is the practical impossibility of the using the method to warranty the seal of the junction with the passage of time. Moreover, the amount of cement that actually provides a seal is limited to the cement that actually fills the interstices around the junction between the casing and the formation. Accordingly, pockets filled with mud may prevent the flow of cement into those pockets and therefore could result in structural weakness of the junction. As well, the dirt and debris from the formation can easily mix with and contaminate the cement as it fills the interstices so that the cement is less effective for sealing purposes.

U.S. Patent No. 5,795,924 to Chatterji et al. (the '924 patent), U.S. Pat. No. 5,820,670 to Chatterji et al. (the '670 patent) and 6,006,835 to Onan et al (the '835 patent), which are hereby incorporated herein by reference, disclose use of more elastic materials such as epoxy resin materials or a cement slushy that may be used to provide resilient cement compositions. The cement compositions have improved mechanical properties including elasticity and ductility and may, for instance, be basically comprised of cementitious material, an aqueous rubber latex and a latex stabilizer. Unfortunately, these cements do not necessarily overcome the problems discussed earlier related to pockets, difficult to reach interstices around the junction, and contamination or mixture of such materials by downhole chemicals which may include a wide variety of contaminants. Merely pumping such cements at higher pressures or velocities will not necessarily result in displacing existing fluids or reaching all pockets around the junction. Moreover, high pump pressures and flow velocities may actually increase contamination or mixture problems.

As well, prior art methods for drilling multilateral wells have often required that the lateral well be of a smaller diameter than the primary wellbore. This reduction in size can severely limit further operations in the lateral well. Additional patents related to the aforesaid prior art and attempts to solve related problems include the following:

U.S. Pat. No. 5,945,387, issued Aug. 31, 1999, to Chatterji et al., discloses polymeric well completion and remedial compositions which form highly pliable and durable impermeable masses of desired rigidity and methods of using the compositions. The compositions are basically comprised of water, a water-soluble polymerizable monomer, a polymerization initiator and an oxygen scavenging agent. The compositions are usually foamed and can contain a gelling agent and a solid filler material to increase the density and/or rigidity of the impermeable mass formed and/or a vulcanizable rubber latex, vulcanizing agent and vulcanizing activator to provide durability and other properties.

U.S. Pat. No. 5,992,524, issued Nov. 30, 1999, to Stephen A. Graham, discloses a method and apparatus for flow control in a wellbore in a well having at least one deviated wellbore drilled as an extension of the primary wellbore. More specifically, an assembly is run into the primary wellbore, aligned and anchored and a retrievable or replaceable flow control device is installed within the assembly.

U.S. Pat. No. 6,047,774, issued Apr. 11, 2000, to David W. Allen, discloses the reduced time required for establishing a multilateral well by enlarging a section of a wellbore and running a multilateral tool into the enlarged wellbore section. The multilateral tool, which is suitable for running into a wellbore on a primary casing string, includes a preassembled combination of casing sections that are used to form dual casings strings extending from the primary casing. The multilateral tool incorporates three casing sections, which maintain the diameter of the primary casing, including: a carrier section, a lateral section, and a main section. In use, the tool is run with the lateral section releasably held in coaxial alignment within the carrier section, and with the main casing section fixed to the lower end of the carrier section. Once in place in the enlarged section of the wellbore, the lateral section is released and diverted out of a preformed window in the lower end of the carrier section and runs generally parallel to the main casing section. In this manner a lateral junction is formed at the carrier casing window in which dual casing strings are connected to the primary casing. A second window, which is preformed in the upper end of the lateral section is aligned with the bore of the primary casing when the lateral casing section is fully extended out of the carrier section window, thus permitting recovery of a diverting device incorporated in the carrier casing section through the second window. The dual strings are then individually drilled and completed to target locations with pressure integrity between the dual strings maintained by using straddle equipment across the lateral junction.

U.S. Pat. No. 6,003,601, issued Dec. 21, 1999, to James R. Longbottom, discloses a method of completing a subterranean well and associated apparatus therefor provide efficient operation and convenience in completions where production of fluids occur from a lateral wellbore and a parent wellbore. In one disclosed embodiment, the invention provides a method whereby a tubular member may be extended from a parent wellbore into a lateral wellbore, without the need of deflecting the tubular member off of a whipstock or other inclined surface. The tubular member may be previously deformed and initially constraining within a housing, so that as the tubular member extends outwardly from the housing, the tubular member is permitted to deflect laterally toward the lateral wellbore.

U.S. Pat. No. 5,896,927, issued Apr. 27, 1999, to Roth et al., discloses methods of stabilizing the portion of an openhole lateral well bore adjacent to and extending a distance from the junction of the lateral well bore with a primary well bore to prevent erosion and deformation of the lateral well bore during subsequent drilling and other operations. The methods basically comprise introducing a cement slurry into the portion of the lateral well bore adjacent to and extending a distance from the aforesaid junction under hydraulic pressure whereby the cement slurry enters voids and pore spaces in the walls of the well bore, allowing the cement slurry to set into a hard mass in the lateral well bore and then drilling excess set cement out of the lateral well bore. The stabilization ensures that when a liner is cemented in the lateral well bore, the junction between the liner and the casing in the primary well bore is sealed.

U.S. Pat. No. 5,730,221, issued Mar. 24, 1998, to Longbottom et al., discloses methods of completing a subterranean well provide access to a portion of a parent wellbore which has been closed off by a lateral wellbore liner. In a preferred embodiment, a method includes the steps of depositing cement in the lateral wellbore liner and then drilling through the cement and liner utilizing a bent motor housing conveyed on coiled tubing. The cement provides lateral support for a cutting tool while it is milling through the liner.

U.S. Pat. No. 5,803,176, issued Sep. 8, 1998, to Blizzard, Jr. et al., discloses a method for milling an opening in a tubular in a wellbore, the method comprising installing a mill guide in the tubular at a desired milling location, inserting milling apparatus through the tubular and through the mill guide so that the milling apparatus contacts the tubular at the desired milling location and contacts and is directed toward the tubular by the mill guide, and milling an opening in the tubular. In one aspect the method includes installing a whipstock in the tubular and disposing the mill guide adjacent the whipstock to protect a concave portion of the whipstock. In one aspect the method includes retrieving the mill guide from the wellbore and in another aspect includes retrieving the whipstock from the wellbore.

U.S. Pat. No. 5,862,862, issued Jan. 26, 1999, to Jamie B. Terrell, discloses an apparatus and associated methods of using provide access to a portion of a parent wellbore that has been separated from the remainder of the parent wellbore by a lateral wellbore liner. In a preferred embodiment, an apparatus has a cutting device, which may be a torch, a housing containing the cutting device, and an anchoring structure to fix the axial, radial, and rotational position of the apparatus relative to the liner. A firing head may be utilized to activate the cutting device.

Consequently, it is submitted that the prior cited hereinbefore, which does not include my recently filed prior patent applications, does not show a reliable technique for establishing a seal between a primary wellbore and one or more lateral wellbores. The prior art does not teach how to avoid contamination of the materials used to form a seal such as cement, epoxies, resins, or the like. The prior art does not disclose how to fill all the interstices between the casing in the primary wellbore and the liner in the lateral wellbore. Moreover, the prior art does not teach how to form a reliable seal with a reduced diameter under-reamer or hole opener. Therefore, what is needed is to somehow consistently and reliably provide a seal between a primary well and one or more lateral wells that will maintain a seal over a long period of time that may utilize a smaller diameter under-reamer. Those skilled in the art will appreciate the present invention which addresses these and other problems.

SUMMARY OF THE INVENTION

The present invention relates generally to an improved method of drilling multilateral wells. The method may comprise steps such as installing an arcuate guide, filling a portion of a primary wellbore with a stress resistant cement or epoxy resin, drilling an arcuate path through the hardened material to reestablish the primary well, and drilling a lateral well from the primary wellbore whereby the substance used in the primary wellbore seals and isolates the formation about the lateral wellbore while allowing a lateral well to be drilled that is substantially the size of the primary wellbore. More particularly, the substance used to fill the area about the junction resists cracks and fissures and retains a seal through the passage of time.

Thus, a method is provided for forming a sealed junction between a first wellbore and one or more lateral wells which branch from the first wellbore. The method may comprise one or more steps such as, for instance, enlarging a portion of the first wellbore to form an enlarged section of the first wellbore, installing an arcuate guide within the enlarged section, and then pumping material into the enlarged section. The material hardens within the enlarged section. Additional steps may include forming the one or more lateral wells by drilling out a lateral path through the hardened material whereby an interconnection of the first wellbore and the one or more lateral wells is formed within the hardened material.

In one embodiment of the invention, the material comprises an epoxy material.

Another step of the invention may include running the arcuate drillable guide into the first wellbore before the step of pumping. Additionally, the method may comprise reestablishing the first wellbore by utilizing the arcuate drillable guide for guiding a drill bit.

Preferably the method comprises positioning a deflection assembly within the arcuate primary well path. The deflection assembly may be created by mounting a whipstock to a sleeve within the primary well path.

In one presently preferred embodiment, the method includes positioning a packer within the enlarged section. Preferably the method then comprises inflating the packer during the step of pumping by pumping the material into the packer. In one embodiment, the method comprises positioning a packer around the drillable guide.

In other words, the method of the present invention may comprise filling a section of the first wellbore with a fluid material which hardens to form a solid material, and initiating drilling of the second wellbore from an arcuate section of the first wellbore to thereby form a junction of the first wellbore and the second wellbore within the solid material.

Thus, a downhole connection arrangement is created between a first wellbore and a second wellbore branching from the first wellbore. The connection arrangement may comprise elements such as an impermeable body formed of hardened material. The impermeable body may be positioned within the first wellbore. The body defines therein an arcuate first passageway. The arcuate first passageway may be an extension of the first wellbore. The body defines a second passageway therein. The second passageway may be an extension of the second wellbore. The first passageway and the second passageway interconnect within the hardened material of the body.

In one embodiment, the body is positioned within an enlarged portion of the first wellbore. In one presently preferred embodiment, the arrangement further comprises an inflatable packer with the body may be positioned within the inflatable packer.

A hollow orientation sleeve may be mounted within the body. Moreover, in one embodiment of the invention the impermeable body is substantially cylindrical.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS OF THE INVENTION

The present invention reliably provides a long term, stress resistant, sealed junction between a primary wellbore and one or more lateral wellbores.

Figure 1:
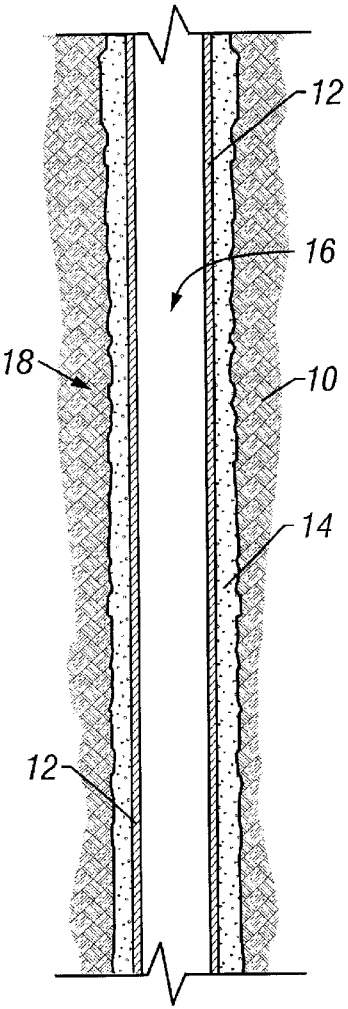
FIG. 1 is an elevational view, in section, of an existing wellbore, cased and cemented.

Referring now to the drawings and, more particularly to FIG. 1, wherein a typical downhole construction of an existing primary wellbore, cased and cemented, is illustrated. As shown in the illustration, the wellbore may appear to be vertically oriented, however, it should be understood that the present invention is suitable for non-vertical wellbores and so the actual orientation of the wellbore in FIG. 1 may be vertical or offset from the vertical, i.e., deviated. Moreover, the present invention is applicable to open hole wellbores or open hole sections that are not cased or lined, or cemented. In general, it will be understood that such terms as "up," "down," "vertical," and the like, are made with reference to the drawings and/or the earth and that the devices may not be arranged in such positions at all times depending on variations in operation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. Thus, the relative sizes, dimensions, and the like, of the components may be greatly different from that shown.

Figure 5A:
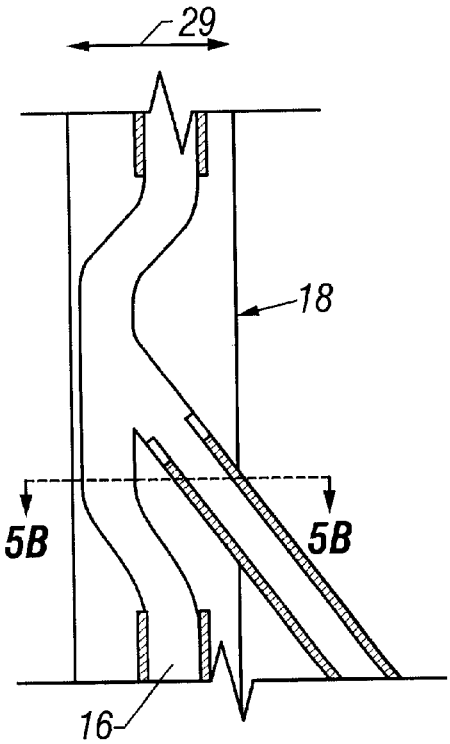
FIG. 5A is a conceptual elevational view, in section, of a lateral well extending from primary wellbore in accord with the present invention.

For instance, in most figures including and after FIG. 5A, bends are shown in exaggeration in downhole systems for purposes of explanation. As a general rule which may vary from well to well, there may a limit as to how much of a bend may preferably be allowed in a well, e.g., less than a three degree change per one hundred feet. The schematics therefore presume that this limit is met. For instance, a change of one foot in the center of the wellbore within about fifty feet is roughly representative of the type of downhole situation presented herein and would represent a variation of about one degree per one hundred feet so as to be well within tolerances. Of course, lengths could be expanded to further decrease the change in angle per one hundred feet, as desired. The use of a drillable preformed acuate guide for the drill bit, as discussed herein provides for rather precise drilling to avoid problems of inadvertent wellbore direction changes and making the process even more reliable.

FIG. 1 provides a view of a section of wellbore in which it is desired to form a lateral wellbore. FIG. 1 is illustrative of a well that is completed with steel casing 12 and cement 14 around wellbore 16 positioned within downhole formation 10. The manner of selection of an area and depth at which to drill a lateral wellbore may be made by any means common in the art. For instance, the selected location may be chosen due to proximity to a pay zone target. However, there are numerous other reasons an operator may desire to drill a lateral well. The section of borehole or borehole region selected from which to kick off the lateral well is referred to herein as selected borehole section 18. The length of borehole section 18 may vary depending on the well program and may typically, but not necessarily, be in the range of about fifty to two hundred feet in length with about fifty to one hundred feet being a nominal length.

Figure 2:
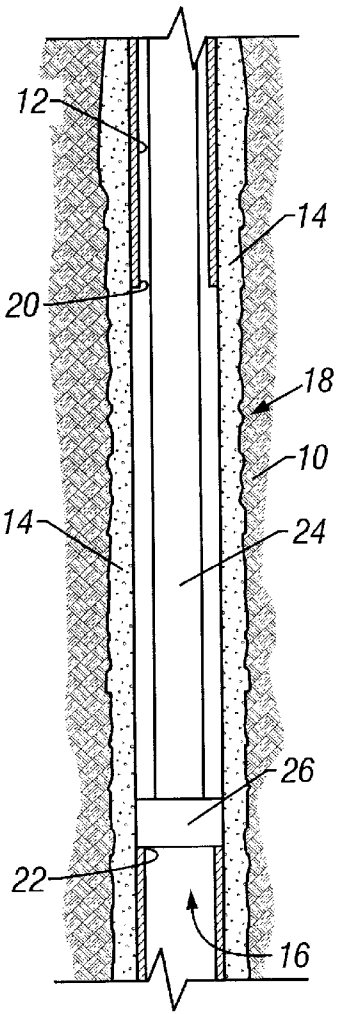
FIG. 2 is an elevational view, in section, of a wellbore where the casing has been milled out at the preselected location.

In accord with the invention, as illustrated by FIG. 2, a section of casing 12 is removed from borehole section 18 leaving a bottom casing end 20 and an upper casing end 22. Thus, a specific portion of casing 12 at a selected depth and usually of a predetermined length is removed such as by milling or any other means to thereby expose cement 14 and/or formation 10 along the milled out section 18, sometimes referred to as the window in casing 12.

Section milling is common in the art and may include the steps of lowering a drilling or milling string 24 as shown in FIG. 2 into well bore 16. The milling string 24 has a mill 26 operably attached thereto. In a preferred embodiment, the section mill 26 initiates operation at casing bottom end 20 and stops milling at upper casing end 22 whereby the casing is removed such as by fluid circulation to thereby form milled out section or window 18. However, it will be understood that the present invention may be used with any means to remove the casing and enlarge wellbore 16 in the region of section 18.

Figure 3B:
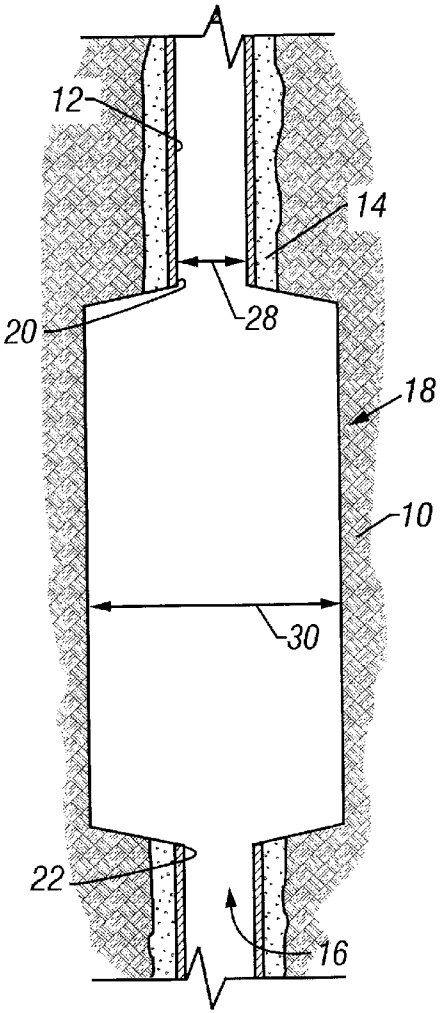
FIG. 3B is an elevational view, in section, of an under-reamed section of wellbore in accord with my previous invention referenced herein.
Figure 3A:
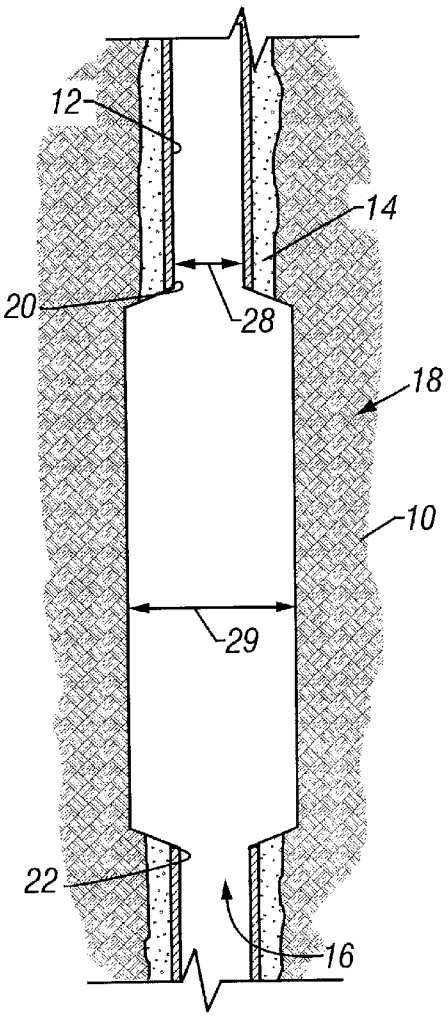
FIG. 3A is an elevational view, in section, of a reduced diameter under-reamed section of wellbore in accord with the present invention.

FIG. 3A provides a profile view of under-reaming of section 18 in accord with the present invention to thereby enlarge the wellbore diameter by a reduced under-reamed diameter 29. Thus, during the milling and under-reaming process, the wellbore diameter is increased from internal diameter 28 of casing 12 to under-reamed diameter 29. FIG. 3B shows my invention as per my aforementioned applications utilizing a larger diameter under-reamed diameter 30 for comparison purposes. Diameter 30 may in the range of about 3 to 3.5 times or more of the diameter 28 of the wellbore to thereby enable a lateral wellbore with at least approximately the same internal diameter of casing 12 to be drilled from primary wellbore 16 having a sealed junction. It may be further observed that the ratio of under-reamed width 12 to borehole width 28 of FIG. 3A is smaller than the ratio of under-reamed width 30 to borehole width 28 of FIG. 3B. In one presently preferred embodiment of the present invention, as depicted in FIG. 3A, the ratio of under-reamed width 12 to borehole width 28 is about 2.0 to 2.5. Moreover, the ratio may be calculated to take into account the size of the lateral well so as to be about 2.0 to 2.5 times the width of the average of the diameters of the primary well and lateral well. The manner of achieving the reduced under-reaming will be described below. Utilizing a reduced under-reaming diameter may well reduce problems discussed briefly hereinbefore that may occur during and subsequent to under-reaming. However, those of skill in the art will be able to use concepts of the present invention as taught herein for establishing a sealed junction between a primary wellbore and one or more lateral wellbores of selectable diameter from any sized primary wellbore and any size under-reamed area. After creating under-reamed section 18, a caliper survey may be run to verify operation of the under-reamer along the length of under-reamed section 18 and to calculate a relatively exact volume of material that will be pumped into under-reamed section 18 as described subsequently. While milling and under-reaming is a preferred method of creating an enlarged section 18 in a cased hole, any method or combination of methods for enlarging section 18 could be used including washing section 18 out such as by pumping, using any type of expandable drill or hole opener, explosives, or the like with the object being to form a cavity that is to eventually filled with a hardened material in which the sealed joint is formed as discussed hereinbelow.

Figure 4A:
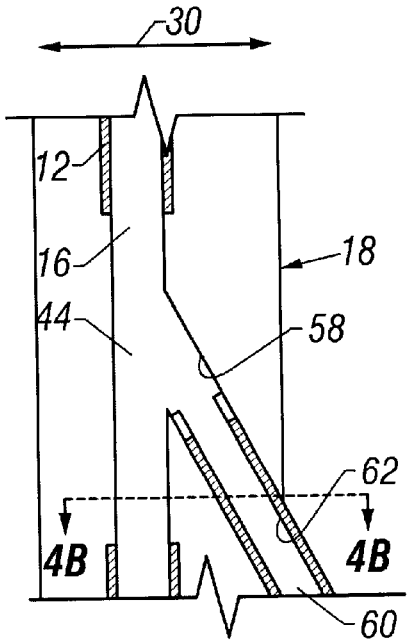
FIG. 4A is an elevational view, in section, of a lateral well extending from primary wellbore in accord with my previous invention referenced herein.
Figure 4B:
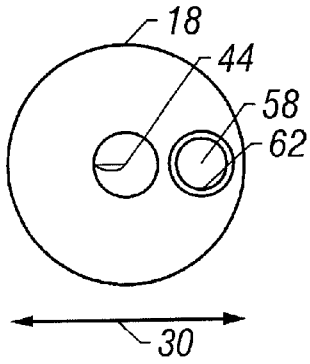
FIG. 4B is a top view, in section, along lines 4B—4B of FIG. 4A.

FIG. 4A, FIG. 4B, FIG. 5A, and FIG. 5B conceptually show some differences between the methods of my previous application and the present method which utilizes a reduced under-reaming diameter. FIG. 4A and the corresponding cross-sectional view of FIG. 4B illustrate one embodiment of the method of my previous application. In FIG. 4A, passageway 44 through filled in and under-reamed section 18 is substantially straight and substantially centralized within under-reamed section 18. Because passageway 44 is centralized within under-reamed section 18, additional under-reamed width is necessary to permit hanging of liner 62 within the material, such as epoxy material, with which under-reamed section 18 is filled as discussed in my previous application to thereby effect a sealed junction.

Figure 5B:
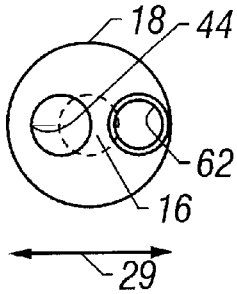
FIG. 5B is a top view, in section, along lines 5B—5B of FIG. 5A.

On the other hand, FIG. 5A and FIG. 5B conceptually show a more efficient use of the space within smaller diameter under-reamed section 18. Passageway 44 here is angled such that intersection 100 is at a position of arcuate passageway 44 that is offset from the center of under-reamed section 18. Thus, additional room is provided for the length of drilled passageway 58 whereby liner 62 can be mounted within the material, such as epoxy, with which under-reamed section 18 is preferably filled. Further details of how an arcuate path 44 can be reliably and precisely drilled are discussed hereinafter.

Figure 6B:
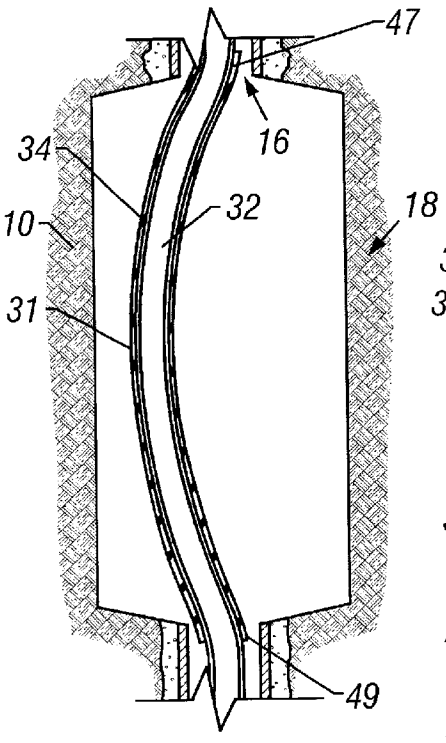
FIG. 6B is an conceptual elevational view, in section, of an arcuate guide with an inflatable packer element in accord with the present invention.
Figure 6A:
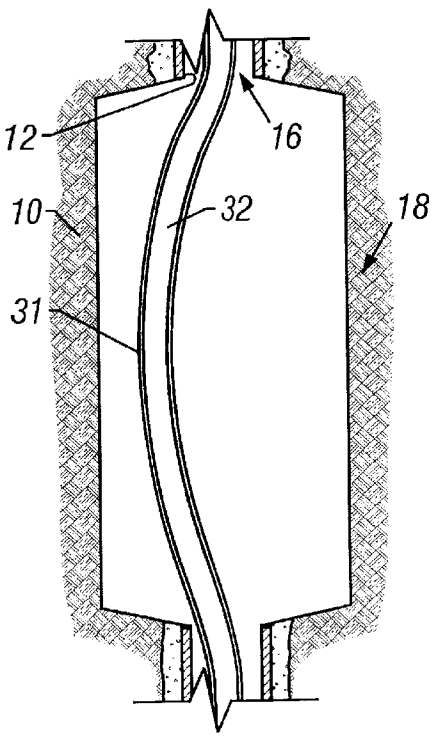
FIG. 6A is a conceptual elevational view, in section, of an arcuate guide run into the wellbore in the region of the under-reamed section of wellbore of FIG. 3A.

Now referring to FIG. 6A, in one presently preferred embodiment, a preformed arcuate drillable guide 32 is run into wellbore 16 preferably through the length of under-reamed section 18. It will be observed that the pre-bent drillable guide 32 is not straight but rather is arcuate within under-reamed location 18. Arcuate drillable guide 32 follows a path from original upper wellbore 16, bends along its length, and then returns to lower wellbore 16. Thus, in an embodiment of the present invention, preformed arcuate guide 32 is lowered into the wellbore 16 to provide an arcuate guide within under-reamed section 18. Drillable guide 32 is preferably used to guide the drill bit to reconnect primary well 16 through under-reamed section 18 as discussed subsequently. Although drillable guide 32 is used in a presently preferred embodiment of the invention, the concept of the invention is applicable whether any guide, such as drillable guide 32 is used or not. Drillable guide 32 may be made of aluminum, plastic, or any other suitable material that can be used for guiding the drill bit and which is relatively easily drillable. Drillable centralizers (not shown) and the like may be used for centralizing the position of drillable guide 32 with respect to casing 12 and for guiding drillable guide 32 through under-reamed section 18. Drillable guide 32 will have an outer diameter smaller than inner diameter 28 of casing 12 but could have any diameter suitable for guiding a drill bit as discussed subsequently. Arcuate drillable guide 32 may be springy or resilient and thereby have a greater span of bend than the diameter of casing 12 when arcuate drillable guide 32 is positioned within under-reamed section 18. Preferably, but not necessarily depending on the length of under-reamed section 18, arcuate drillable guide 32 is positioned such that apex 31 of the curve of arcuate drillable guide 32 is centrally located within under-reamed section 18. This positioning of apex 31 permits the most gradual curve although, as discussed hereinbefore, the general curve may easily be selected to be well with the maximum rate of change in the wellbore according to the drilling program.

Now referring to FIG. 6B, drillable guide 32 is shown with inflatable packer element 34 surrounding drillable guide 32. Although the packer element 34 is a preferred feature to solve certain problems discussed hereinbefore, packer element 34 is not a required feature of the present invention. Inflatable packer 34 may be used to solve problems such as the problem of contaminants mixing with the material used to form a junction between the primary wellbore and one or more lateral wellbores in a manner explained in more detail subsequently. Inflatable packer 34 may be a part of guide 32, or may be a separate device used with or without an additional drilling guide means. Inflatable packer 34 may be designed in many ways with the constraint being that inflatable packer 34 operates to expand in the manner discussed below. Preferably inflatable packer 34 has a length that extends at least over a substantial portion of under-reamed section 18 and, in the illustrated embodiment, extends throughout the entire length of under-reamed section 18.

Figure 7:
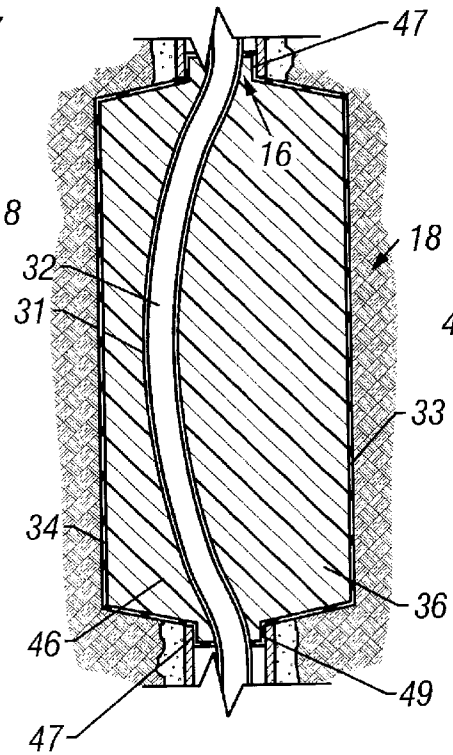
FIG. 7 is an conceptual elevational view, in section, of an inflatable packer positioned within the under-reamed section of wellbore filled with material in accord with the present invention.

Now referring to FIG. 7, there is illustrated a step of the method of the present invention after the situation shown in FIG. 6B. Note that while FIG. 7 indicates the presence of packer 34, packer 34 may or may not be used. In FIG. 7, material 36 has been injected to fill in under-reamed section 18 in accord with the present invention and in accord with my previous invention referenced hereinbefore. Material 36 is liquid when pumped into under-reamed section 18 and then sets up as a solid material to form the basic structure of the sealed junction in accord with the present invention. Material 36 may be one of many types of suitable cement and may include materials that are pliable or stretchable such as rubber, epoxy, and other cement materials such as those taught in the prior art listed in this application or other materials suitable for the purposes of this invention. In one embodiment of the invention, an epoxy cement material is produced from a pumpable material comprising epichlorohydrin and bisphenol. The pumpable material 36 hardens after injection into under-reamed section 18. This epoxy resin and its derivatives provide a high degree of impermeability while providing flexibility for shifts in the formation. Other materials that perform these same functions as discussed herein might also be used. Often, these epoxy resin materials will include a liquid diluent containing a substance to allow the epoxy to have a sufficient viscosity as the liquid epoxy material is pumped through wellbore 16 to preferably completely fill under-reamed section 18. As well, another embodiment of the present invention utilizes an additive within pumped material 36 to change the time of hardening of the material, such as cement. The additive may be either a retardant to prevent premature hardening or setting up of the material within the wellbore or an accelerator to hasten the hardening of material 36.

In the embodiment of FIG. 7, arcuate drillable guide 32 defines an arcuate path through under-reamed section 18 after hardened material 36 preferably completely fills under-reamed section 18 surrounding arcuate drillable guide 32. It will be noted that material 36 is preferably injected prior to drilling the one or more lateral wells. After hardening of material 36, arcuate drillable guide 32 or other means such as directional drilling may be used for reconnecting primary wellbore 16 along the length of under-reamed section 18 as discussed subsequently. By filling under-reamed section 18 before drilling the lateral wells, many problems are avoided such as washouts, formation fractures and the like. However, certain features of the present invention such as forming a monolithic junction in accord with a preferred embodiment of the invention could conceivably be utilized with a different sequence of drilling operation. Thus, material 36 hardens to form impermeable body 46 with outer surface 33 that is substantially conformable to under-reamed section 18. Outer surface 33 of impermeable body 46 will typically be substantially cylindrical in shape although this shape may vary to conform to the outline of under-reamed section 18 which will typically have some variations in diameter as the under-reamer or other hole opener will typically not produce a perfect cylindrical wall especially in some formations. Impermeable body 46, which is formed of hardened, pliable, impermeable material 36, will be modified by drilling passageways therein as discussed subsequently such that impermeable body 46 forms a sealed joint therein. Thus arcuate drill guide 32 and/or packer 34 will be cemented into position within under-reamed section 18.

Figure 8:
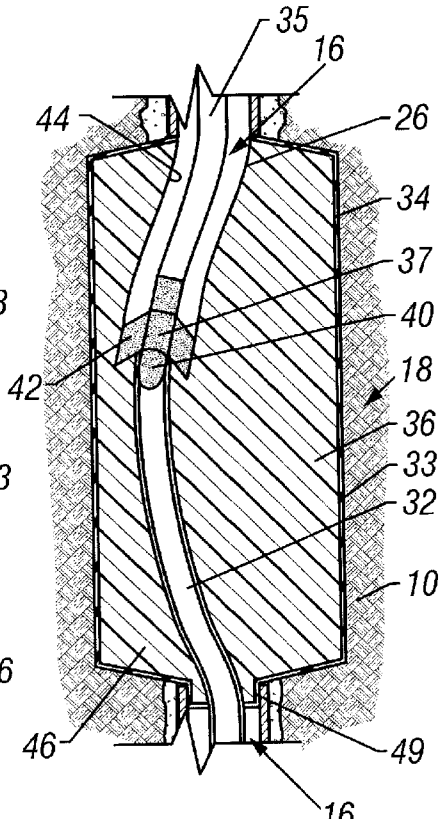
FIG. 8 is an conceptual elevational view, in section, which shows drilling through the hardened material along an arcuate path with the drill bit being directed by a guide in accord with the present invention.

FIG. 8 illustrates a presently preferred step in the method of the present invention whereby arcuate drillable guide 32 is used with pilot mill or drill bit 37 attached to drill string 35 to create sealed arcuate passageway 44 which reestablishes primary bore 16 through under-reamed and filled section 18. Pilot drill 37 is shown conceptually only and may have many different configurations other than as indicated, such as roller cutters, blade cutters other than shown, and the like. Pilot drill 37 preferably includes pilot nose section 40 that extends past drilling elements 42. Drilling elements 42 may be of many configurations, including other types of bits, roller bits, diamond cutters, scrapers, hole-openers, and the like. Drilling elements 42 are used for drilling out arcuate sealed passageway 44 through impermeable body 46. Pilot nose section preferably extends into drillable guide 32 to align or direct drilling so that mill or drill 37 follows the arcuate path defined by arcuate drillable guide 32. Pilot nose section 40 may preferably have a diameter slightly less than the inner diameter of guide 32 to thereby centralize the position of pilot mill or drill bit 37 with respect to guide 32. By using drillable arcuate guide 32, an arcuate passageway 44 is reliably and accurately drilled with a known arcuate shape because arcuate guide 32 is preformed prior to insertion within wellbore 16.

Inflatable packer 34 is preferably constructed of an elastic substance such as rubber or an elastomer. As stated before, inflatable packer 34 may or may not be used, as desired. Moreover, inflatable packer may be comprised of any suitable material that stretches radially outwardly to expand to fill under-reamed section 18. Thus, for instance, if under-reamed section 18 has a diameter four times greater than the diameter of uninflated packer element 34 as shown in FIG. 6B, then packer 34 should expand four times the uninflated diameter of packer element 34. Thus, after the under-reaming operation, packer 34 is inflated with material 36 which may comprise epoxy resin such as an armoured epoxy. A typical method of inflating packer 34 may involve pumping material 36 while material 36 is a fluid into packer 34 to thereby inflate and expand packer 34. In FIG. 7 packer 34 has expanded to completely fill under-reamed section 18. In one embodiment, packer 34 may have a length slightly longer than under-reamed section 18 such that casing 12 is partially filled with material 36 at upper packer end 47 and lower packer end 49.

The use of inflatable packer 34 will ensure that upon inflation no contaminant from the formation will be mixed with material 36 and affect the hardening or consistency of material 36 which is used to form the sealed junction in accord with the present invention within impermeable body 46. Moreover, inflatable packer 34 insures that material 36 is deposited exactly at the desired location in wellbore 16, namely within under-reamed section 18, by forming a border around under-reamed section 18 that prevents leakage of material 36 substantially past the upper 47 and lower 49 boundaries of under-reamed section 18. Thus, in a preferred embodiment, under-reamed section 18 is filled with a cement and/or epoxy resin material.

Figure 9:
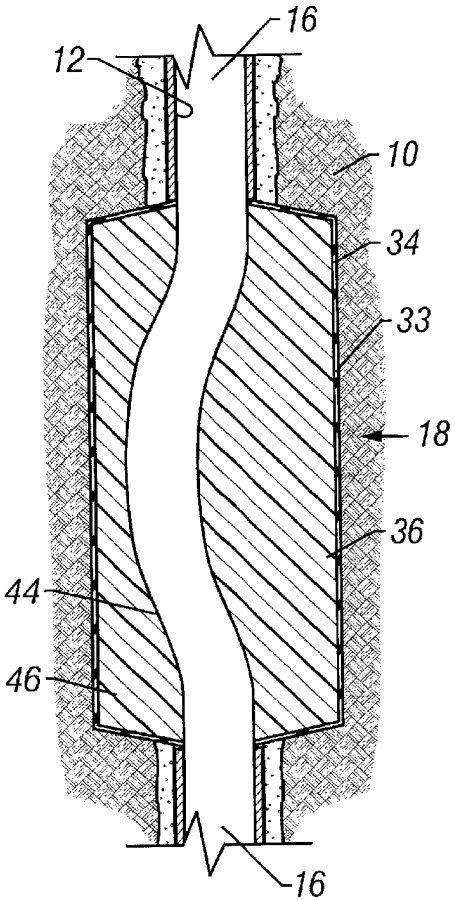
FIG. 9 is an conceptual elevational view, in section, of a sealed wellbore section connecting to the primary wellbore drilled along an arcuate path through the hardened material within the under-reamed section.

Referring now to FIG. 9, an illustration is provided of completed arcuate path 44 through under-reamed location 18 to preferably, if desired, reconnect primary well 16. If, depending on the well program, primary well 16 is not to be further used for example, then it may not be necessary to drill completely through under-reamed location 18 to thereby reconnect primary well 16 at this time. Arcuate passageway 44 is sealed by impermeable body 46 which is formed of hardened material 36, such as epoxy. Impermeable body 46 will have a high degree of strength and resiliency because, unlike prior art methods, material 36 was used to fill the entire volume or substantially the entire volume except for guide 32 of the under-reamed section 18. This complete fill of under-reamed section 18 ensures that impermeable body 46 is very sturdy and that the junction between a lateral well and primary wellbore 16 defined within body 46 may therefore be readily machined downhole without cracking or otherwise damaging impermeable body 46.

Figure 10:
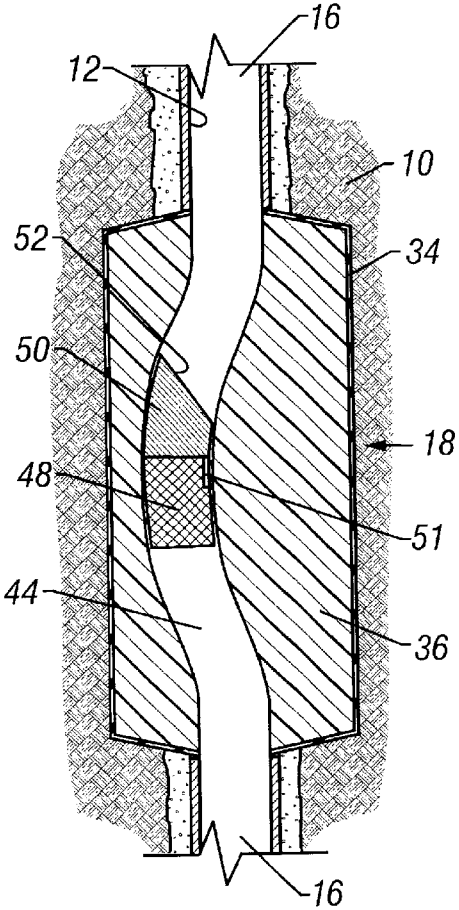
FIG. 10 is an conceptual elevational view, in section, of an embodiment of the present invention whereby a whipstock is mounted to a hollow orienting sleeve positioned within in the sealed passageway of FIG. 9 in accord with a presently preferred embodiment of the invention.

Referring now to FIG. 10, an illustration is provided of hollow orienting sleeve 48 useable with a whipstock such as whipstock 50 shown mounted to orienting sleeve 48. The details of a preferred orienting sleeve are discussed in my subsequent U.S. patent application Ser. No. 09/801,317 filed Mar. 7, 2001, referenced above, and incorporated herein by reference. While orienting sleeve 48 has many advantages, other traditional means for mounting whipstock 50 within the drill path may also be used such as packers, slips, inflatable elements, and the like. Orienting sleeve 48 has an orienting means, such as groove 51 or other alignment means, that aligns whipstock 50 now and also later in the future if desired for reliable reentry purposes. Thus, whipstock 50 is mounted and automatically oriented within body 46 along arcuate passageway 44 such that one or more subsequent lateral wellbores to be drilled will have a joint within body 46. In a preferred embodiment of the method, orientation sleeve 48 is lowered, oriented and anchored in arcuate passageway 44 and whipstock 50 is then placed about the sleeve 48.

Figure 11:
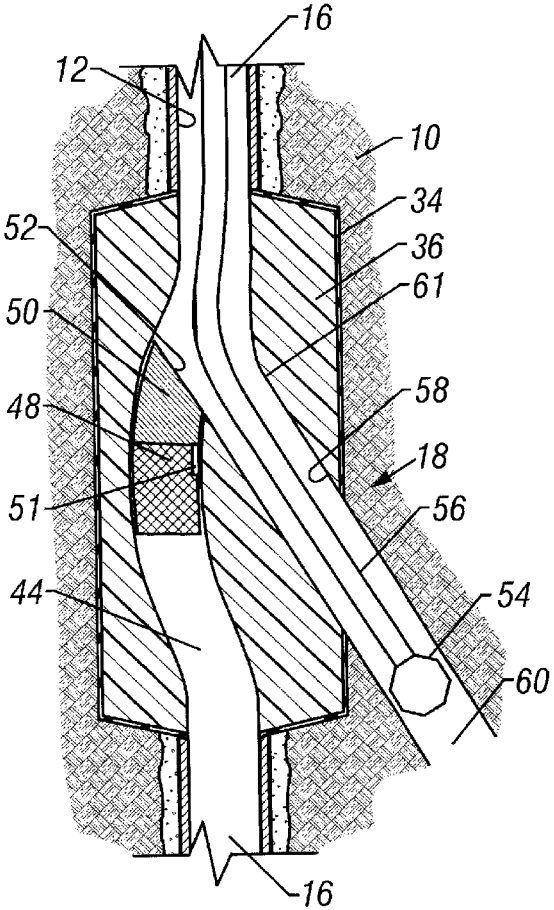
FIG. 11 is an conceptual elevational view, in section, which shows a step of deflecting a drill bit using the whipstock of FIG. 10 within the sealed wellbore for drilling through the hardened material to drill the lateral well.

Using the drill bit deflection configuration of FIG. 10 or other drill bit deflection configurations, it is well known that the selected whipstock face 52 will deflect a drill bit away from the drill path 44 at a desired angle related to the selected whipstock face 52 and other factors such as the bottom hole assembly and the like. The subsequent drilling of lateral well 60 is illustrated in FIG. 11. Drill string 56 supports drill bit 54 as drill bit 54 is deflected from whipstock 50 to thereby drill arcuate lateral passageway 58 through hardened material 36 which forms impermeable body 46. Passageway 58 and arcuate passageway 44 meet within impermeable body 46 to form a sturdy and reliable sealed joint 100 (see FIG. 12) in accord with the present invention. Drilling continues through under-reamed location 18 and out into formation 10 to thereby create lateral wellbore 60 as shown.

Figure 12:
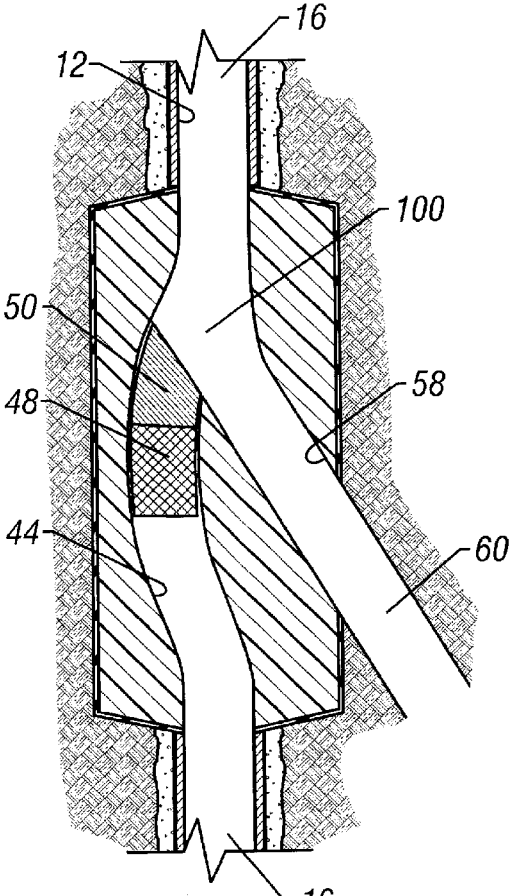
FIG. 12 is an conceptual elevational view, in section, of the completed lateral well with a sealed junction after the drilling assembly is removed.

In FIG. 12 the drill string has been removed. Thus, lateral wellbore 60 has been drilled into a desired formation or pay zone or for other reasons in accord with regular drilling operations. Thus, sealed joint 100 is completely contained within a hardened material 36 comprising substances such as, for instance, epoxy. Sealed joint 100 is impermeable and sturdy.

Figure 14:
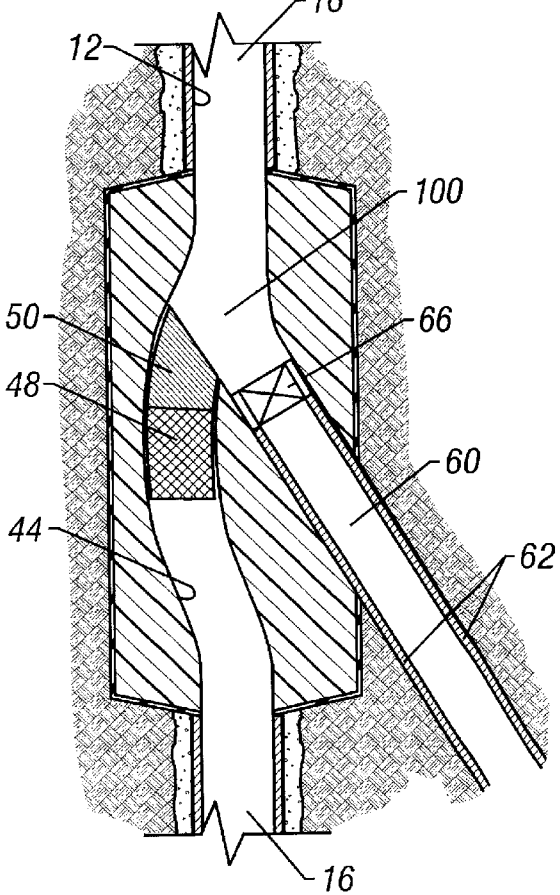
FIG. 14 is an conceptual elevational view, in section, which shows a plug or packer installed within the liner of FIG. 13.
Figure 13:
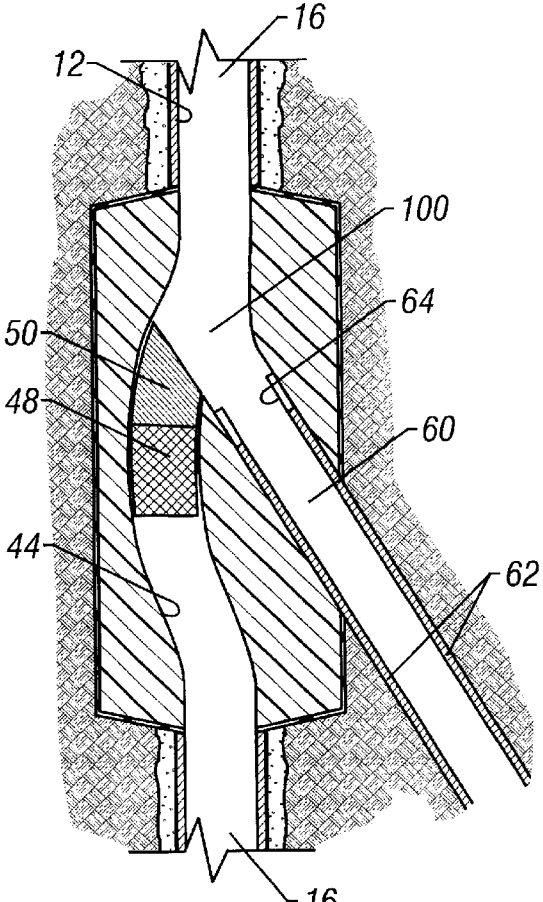
FIG. 13 is an conceptual elevational view, in section, which shows continued work within the lateral wellbore utilizing the sealed junction for installing a lateral liner.
Figure 15:
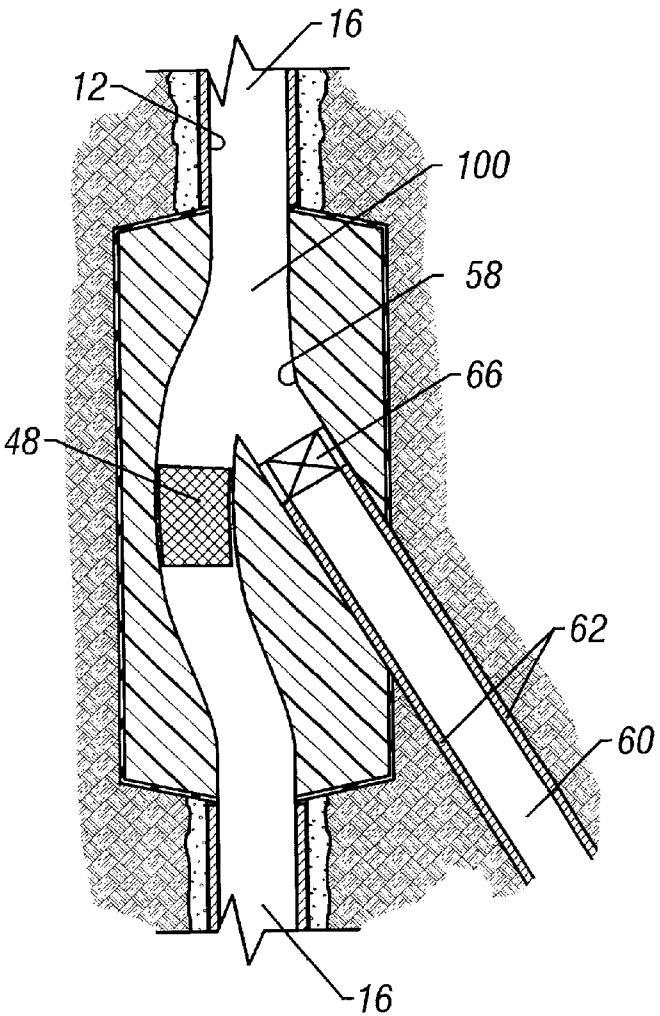
FIG. 15 is an conceptual elevational view, in section, which shows one embodiment of the invention whereby the whipstock assembly removed and access to the primary well is available through the hollow orienting sleeve.

Referring now to FIG. 13, FIG. 14, and FIG. 15, subsequent operations that may occur within the well are disclosed. For instance, liner 62 may be mounted or hung within lateral wellbore 60 preferably with top of liner 64 mounted within material 36 forming impermeable body 46 to thereby effect an excellent seal between liner 62 and impermeable body 46. Thus, no leakage occurs from wellbore 60 around impermeable body 46 into primary wellbore 16 except for any optionally and selectively desired communication through drilled passageways 44 and 58 that have been formed within impermeable body 46.

For instance, if the drilling operator desires to go back into primary wellbore 16, then bridge plug 66 can be mounted within liner 62 at a desired depth to seal lateral well 60 as indicated in FIG. 14. No leakage will then occur between plugged lateral wellbore 60 and primary wellbore 16. Then whipstock 50 can be removed as indicated in FIG. 15. In a preferred embodiment, access is then available to primary wellbore 16 through hollow orienting sleeve 48. While other means to access primary wellbore 16 could also be used, as are known in the art, my preferred embodiment utilizes orienting sleeve 48 which permits whipstock 50 to be reinstalled again at the same exact angle as the initial installation to provide easy access once again to lateral wellbore 60, even years later should that be desired. In accord with my U.S. patent application Ser. No. 09/801,317 filed Mar. 7, 2001, one or more orienting sleeves 48 may be used to conveniently reliably allow access to all branches of the wellbore. Moreover, U.S. patent application No. 09/732, 289, filed Dec. 7, 2000, teaches a whipstock that can be conveniently used to produce a selectably oriented configuration of lateral wellbores and selective access to each lateral wellbore.

As discussed in more detail hereinbefore, the present invention allows lateral well 60 to be drilled to a diameter, if desired, that is substantially equivalent to the diameter of the primary wellbore 16. In fact, using expandable hole openers, offset bits, and the like, the diameter of lateral well 60 could be larger than the diameter of wellbore 16 if desired. As such, lateral well 60 is compatible with conventional drilling methods and equipment and does not jeopardize future operations. Thus the present invention results in at least two selectively accessible wellbores whereby the lateral well bore's diameter may be of comparable size to the primary wellbore. Embodiments of the present invention are designed to be used with prior art drilling operations, so the drilling operations do not require any special modifications before implementation.

In summary, one preferred embodiment of the method provides for drilling operations which may comprise one or more of the following steps: utilizing an existing well such as a cased, cemented wellbore 16; section milling a desired section 18 of wellbore 16; under-reaming or hole opening to form under-reamed section 18; running arcuate drillable guide tube 32 such as an aluminum guide tube; filling under-reamed section or cavity 18 with material 36 which may comprise an armoured epoxy; drilling out material 36 along arcuate drillable guide 32 to reestablish primary wellbore 16; orienting and setting hollow orienting sleeve 48; connecting whipstock 50 to orienting sleeve 48; drilling out material 36 as directed by whipstock 50 to form a lateral passageway 58 through impermeable body 46; continuing drilling to one or more drill lateral holes such as lateral hole 60; removing the bottom hole assembly to reveal that sealed junction 100 is established; and hanging liner 62 in lateral wellbore 60. Other steps relating to accessing the primary wellbore may include installing bridge plug 66 in liner 62 and removing whipstock 50 to allow reliable access to primary wellbore 16 through orienting sleeve 48.

It is noted that the embodiments of the Method for Drilling Multi-Lateral Wells With Reduced Under-reaming and Related Device described herein in detail are only provided for exemplary purposes and are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A method of forming a junction between a first wellbore and one or more lateral wells which branch from said first wellbore, said method comprising:

enlarging a portion of said first wellbore to form an enlarged section of said first wellbore;

installing an arcuate drillable guide within said enlarged section;

pumping material into said enlarged section, said material hardening within said enlarged section to form hardened material; and reestablishing said first wellbore by utilizing said arcuate drillable guide for guiding drilling.

2. A method of forming a junction between a first wellbore and one or more lateral wells which branch from said first wellbore, said method comprising:

enlarging a portion of said first wellbore to form an enlarged section of said first wellbore;

installing an arcuate drillable guide within said enlarged section;

pumping material into said enlarge section, said material hardening within said enlarged section to form hardened material;

positioning a packer within said enlarged section; and inflating said packer during said step of pumping by pumping said material into said packer.

3. A method for drilling a second wellbore that branches laterally from a first wellbore, the method comprising the steps of:

filling a section of said first wellbore with a fluid material which hardens to form a solid material;

drilling an arcuate passageway through said solid material for reestablishing said first wellbore;

forming said second wellbore by drilling out a lateral path through said hardened material; and installing an arcuate drillable guide within said section.

4. A method for drilling a second wellbore that branches laterally from a first wellbore, the method comprising the steps of:

filling a section of said first wellbore with a fluid material which hardens to form a solid material;

drilling an arcuate passageway through said solid material for reestablishing said first wellbore;

forming said second wellbore by drilling out a lateral path through said hardened material, wherein said step of filling further comprises plugging said first wellbore with an inflatable packer by pumping said fluid material into said packer.

5. A method for drilling a second wellbore that branches laterally from a first wellbore, the method comprising the steps of:

filling a section of said first wellbore with a fluid material which hardens to form a solid material;

drilling an arcuate passageway through said solid material for reestablishing said first wellbore;

forming said second wellbore by drilling out a lateral path through said hardened material;

under-reaming said section prior to said step of filling.

6. A downhole connection arrangement between a first wellbore and a second wellbore branching from said first wellbore, said connection arrangement comprising:

an impermeable body formed of hardened material which has hardened from a fluid state, said body being positioned along said first wellbore, said impermeable body defining therein a first arcuate passageway, said first arcuate passageway being an extension said first wellbore to interconnect said first wellbore above and below said impermeable body, said impermeable body defining therein a second passageway, said second passageway being an extension of said second wellbore, said first arcuate passageway and said second passageway interconnecting within said impermeable body wherein said body is positioned within an enlarged portion of said first wellbore having a diameter less than about two and one-half times an inner diameter of said first wellbore.

7. A downhole connection arrangement between a first wellbore and a second wellbore branching from said first wellbore, said connection arrangement comprising:

an impermeable body formed of hardened material which has hardened from a fluid state, said body being positioned along said first wellbore, said impermeable body defining therein a first arcuate passageway, said first arcuate passageway being an extension said first wellbore to interconnect said first wellbore above and below said impermeable body, said impermeable body defining therein a second passageway, said second passageway being an extension of said second wellbore, said first arcuate passageway and said second passageway interconnecting within said impermeable body; and an inflatable packer, said body being positioned within said inflatable packer.

8. A downhole connection arrangement between a first wellbore and a second wellbore branching from said first wellbore, said connection arrangement comprising:

an impermeable body formed of hardened material which has hardened from a fluid state, said body being positioned along said first wellbore, said impermeable body defining therein a first arcuate passageway, said first arcuate passageway being an extension said fist wellbore to interconnect said first wellbore above and below said impermeable body, said impermeable body defining therein a second passageway, said second passageway being an extension of said second wellbore, said first arcuate passageway and said second passageway interconnecting within said impermeable body; and a sleeve mounted within said body.

9. A method for drilling a second wellbore that branches laterally from a first wellbore, the method comprising the steps of:

pumping a fluid material into a section of said first wellbore whereupon said fluid material hardens to form a solid material;

drilling an arcuate passageway within said solid material which connects to said first wellbore;

mounting a deflection assembly within said arcuate passageway; and drilling said second wellbore through said solid material to thereby form a junction of said first wellbore and said second wellbore within said solid material.

10. The method of claim 9, wherein said cement comprises an epoxy material.

11. The method of claim 9, further comprising:

installing an arcuate drillable guide within said section.

12. The method of claim 9, wherein said step of pumping further comprises inflating an inflatable packer by pumping said fluid material into said packer.

* * * * *